US005588317A

United States Patent [19]

Bianco

[11] Patent Number: 5,588,317

[45] Date of Patent: Dec. 31, 1996

[54] METHOD AND APPARATUS FOR SEQUENTIALLY UNLOCKING COMPARTMENTS

[76] Inventor: James S. Bianco, 217 Brainard Rd., Enfield, Conn. 06082

[21] Appl. No.: 386,153

[22] Filed: Feb. 9, 1995

[51] Int. Cl.[6] ..... E05B 53/00

[52] U.S. Cl. ..... 70/265; 70/278; 340/825.31; 109/38

[58] Field of Search ..... 70/262–265, 277–280, 70/337–339, 77, 78; 109/24.1, 38–44, 53, 56; 340/542, 543, 825.31; 361/171, 172; 235/382, 491, 492

[56] References Cited

U.S. PATENT DOCUMENTS

| | | | |
|---|---|---|---|
| 1,134,625 | 4/1915 | Locke | 70/265 |
| 2,508,425 | 5/1950 | Schachinger | 70/265 X |
| 2,521,498 | 9/1950 | Beymer et al. | 70/265 |
| 3,124,397 | 3/1964 | Braunsberg | 70/265 X |
| 4,572,254 | 2/1986 | Maeshiba | 70/265 X |
| 4,772,877 | 9/1988 | Rice, Jr. et al. | 109/38 X |
| 4,965,551 | 10/1990 | Box | 340/542 X |
| 4,967,305 | 10/1990 | Murrer et al. | 70/278 X |
| 5,140,317 | 8/1992 | Hyatt, Jr. et al. | 340/825.31 |
| 5,219,386 | 6/1993 | Kletzmaier et al. | 70/278 X |
| 5,225,825 | 7/1993 | Warren | 70/78 X |
| 5,359,322 | 10/1994 | Murray | 70/278 X |
| 5,392,025 | 2/1995 | Figh et al. | 70/264 X |

*Primary Examiner*—Suzanne L. Dino
*Attorney, Agent, or Firm*—John H. Crozier

[57] ABSTRACT

In a preferred embodiment, a system for sequentially unlocking a series of locked compartments, the system including: apparatus to unlock a first one of the locked compartments so that the first one of the locked compartments can be opened and then closed; and apparatus to sense closing of the first one of the locked compartments and to automatically unlock a second one of the locked compartments in response to the closing of the first one of the locked compartments.

6 Claims, 4 Drawing Sheets

METHOD AND APPARATUS FOR SEQUENTIALLY UNLOCKING COMPARTMENTS

BACKGROUND OF THE INVENTION

1. Field of the Invention

The present invention relates to unlocking compartments generally and, more particularly, but not by way of limitation, to novel method and apparatus for sequentially unlocking a series of related compartments.

2. Background Art

While the present invention is described with reference to sequentially opening cash access doors in a casino environment, it will be understood that the invention is applicable to any situation in which it is desired to quickly and conveniently sequentially open a plurality of related compartments.

In gambling casinos, slot machines are frequently adjacently arranged in a row on a supporting structure. Each slot machine has a cash bin disposed in a compartment in the structure under the slot machine into which cash bin coins from the slot machine drop. Access to the compartment is by means of unlocking and opening a door, with a single door giving access to only one cash bin.

Conventionally, each such access door is fitted with two cylinder locks, with the key to one lock being held by a casino employee and the key to the other lock being held by a government inspector. The procedure for removing cash bins from such a row of slot machines is for the casino employee and the government inspector to unlock their respective locks on the first door for access to the first compartment. Then, the cash bin in the compartment is removed, its identity checked, and an empty bin inserted in the compartment. Now, the casino employee and the government inspector each lock their respective locks on the first door and the procedure is repeated sequentially with the second and succeeding doors in the row. This procedure consumes a considerable amount of time in unlocking and locking the cylinder locks.

Accordingly, it is a principal object of the present invention to provide method and means for quickly and conveniently unlocking a series of compartments.

It is a further object of the invention to provide such apparatus that is simple, economical, and easily retrofitted to existing compartments.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an apparatus for sequentially unlocking a series of locked compartments, comprising: means to unlock a first one of said locked compartments so that said first one of said locked compartments can be opened and then closed; and means to sense closing of said first one of said locked compartments and to automatically unlock a second one of said locked compartments in response to said closing of said first one of said locked compartments.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
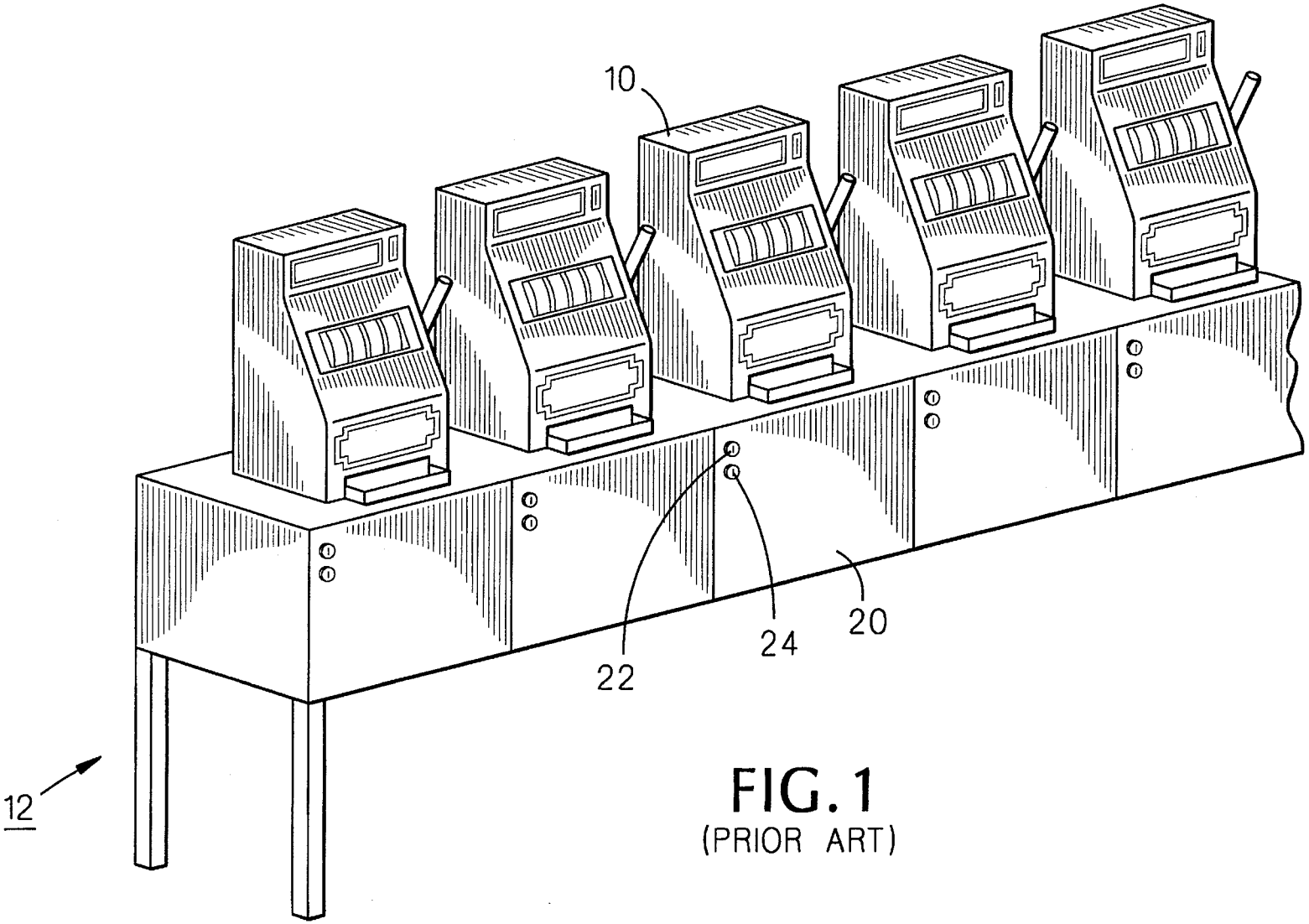
FIG. 1 (PRIOR ART)
FIG. 1 is a perspective view showing a row of slot machines disposed on a conventional structure.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a plurality of slot machines, as at 10, disposed on a conventional supporting structure, generally indicated by the reference numeral 12. Each slot machine 10 is disposed over a compartment (not shown) closed by a door 20, in which compartment is a disposed a cash bin (not shown) into which coins from the slot machine drop. As is indicated above, door 20 is secured by two cylinder locks 22 and 24, each of which must be unlocked to open the door.

Figure 2:
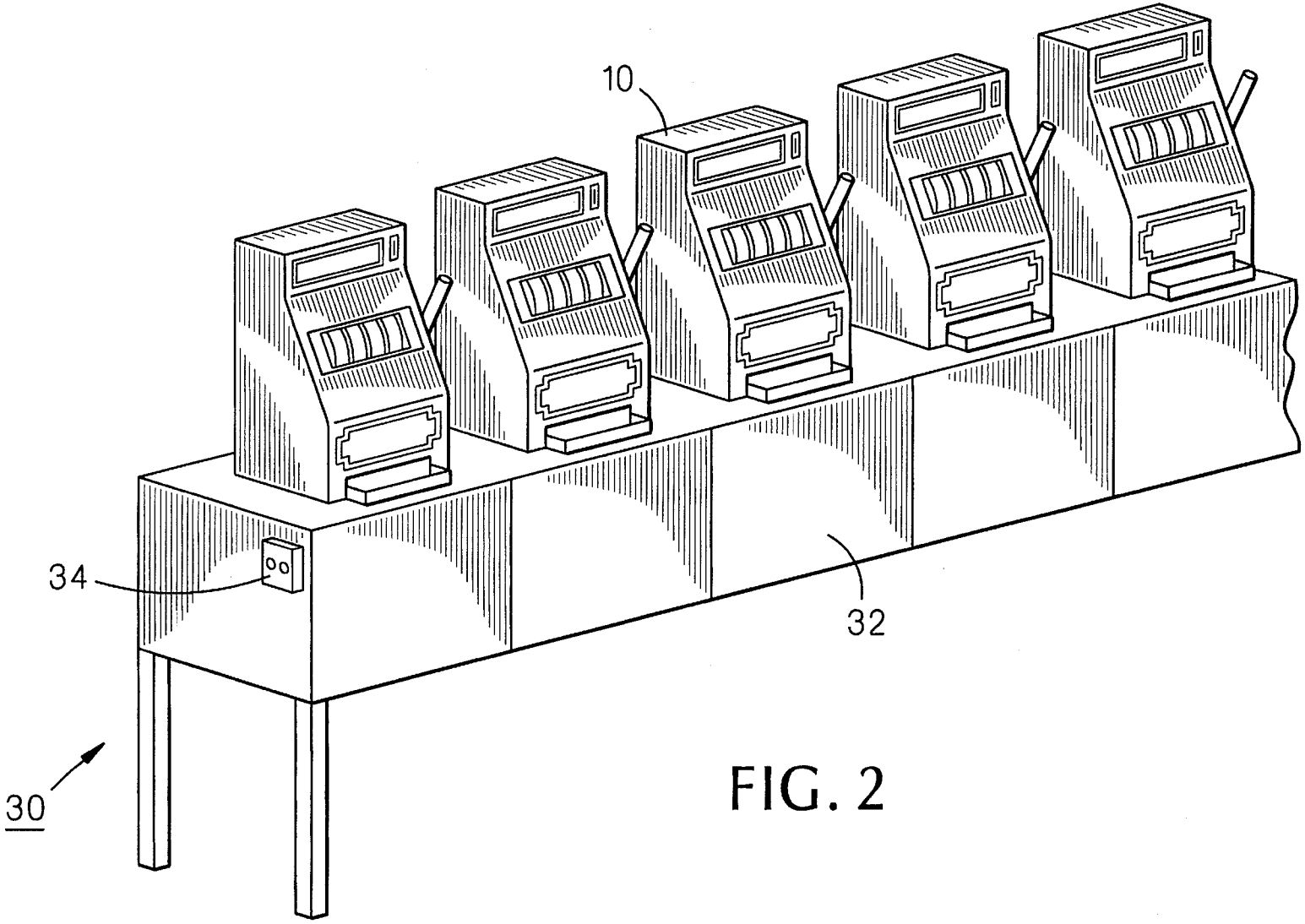
FIG. 2 is a perspective view showing a row of slot machines disposed on a structure according to the present invention.

FIG. 2 illustrates a plurality of slot machines, as at 10, disposed on a supporting structure constructed according to the present invention, generally indicated by the reference numeral 30. Each slot machine 10 is disposed over a compartment (not shown) closed by a door 32, in which compartment is a cash bin (not shown) into which coins from the slot machine drop. In contrast to a conventional supporting structure (10, FIG. 1), door 32 requires no cylinder locks. Opening of door 30 and the other doors in supporting structure 30 is governed by a control system 34 attached to the supporting structure, the operation of which control system will be described below.

Figure 3:
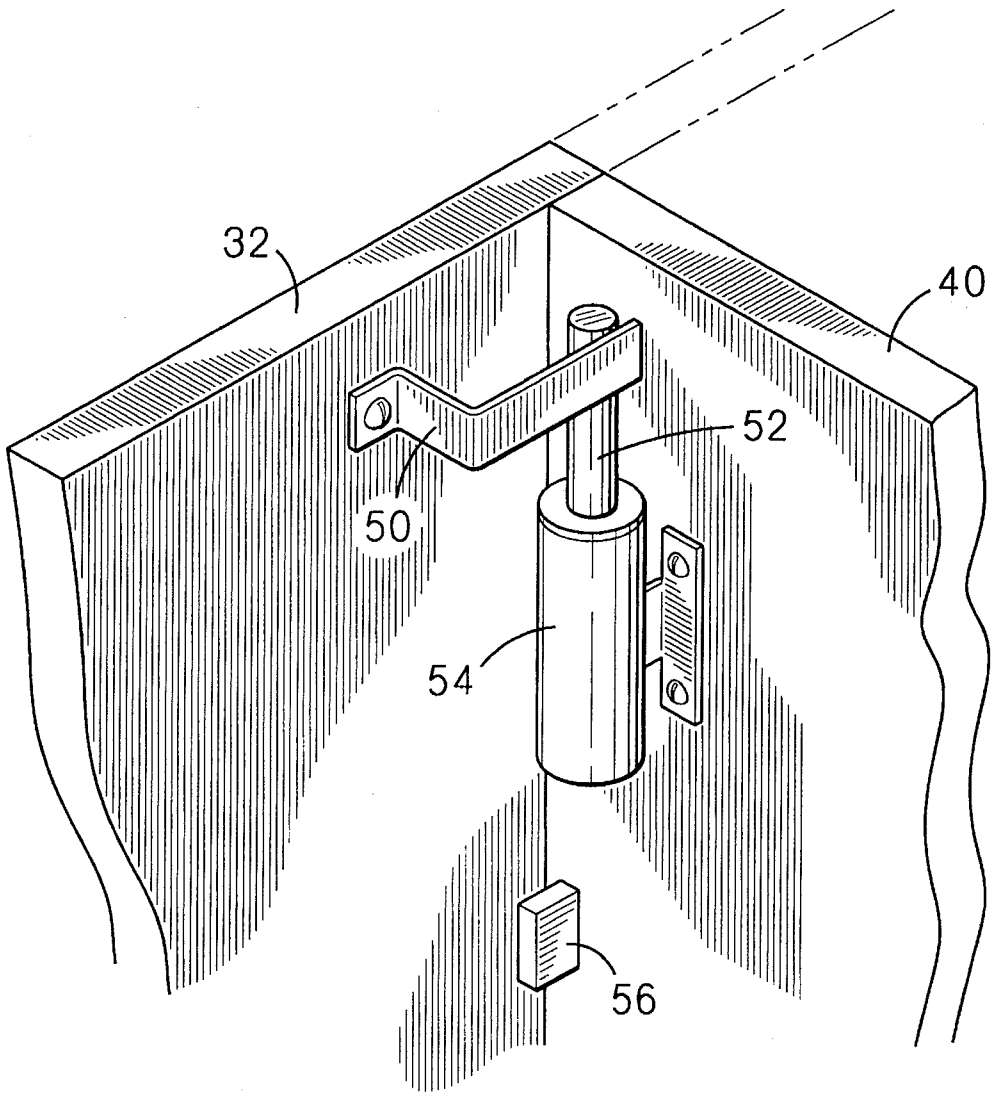
FIG. 3 is a fragmentary, isometric detail showing the locking mechanism of the present invention.

Referring now to FIG. 3, door 32 is held in closed position (FIG. 2) against an interior wall 40 of supporting structure 30 by means of a bracket 50 attached to the door being engaged by a pin 52 extending from a solenoid coil 54 attached to the interior wall. Also attached to interior wall 40 in proximity to door 32 is a closed door detector 56.

Figure 4:
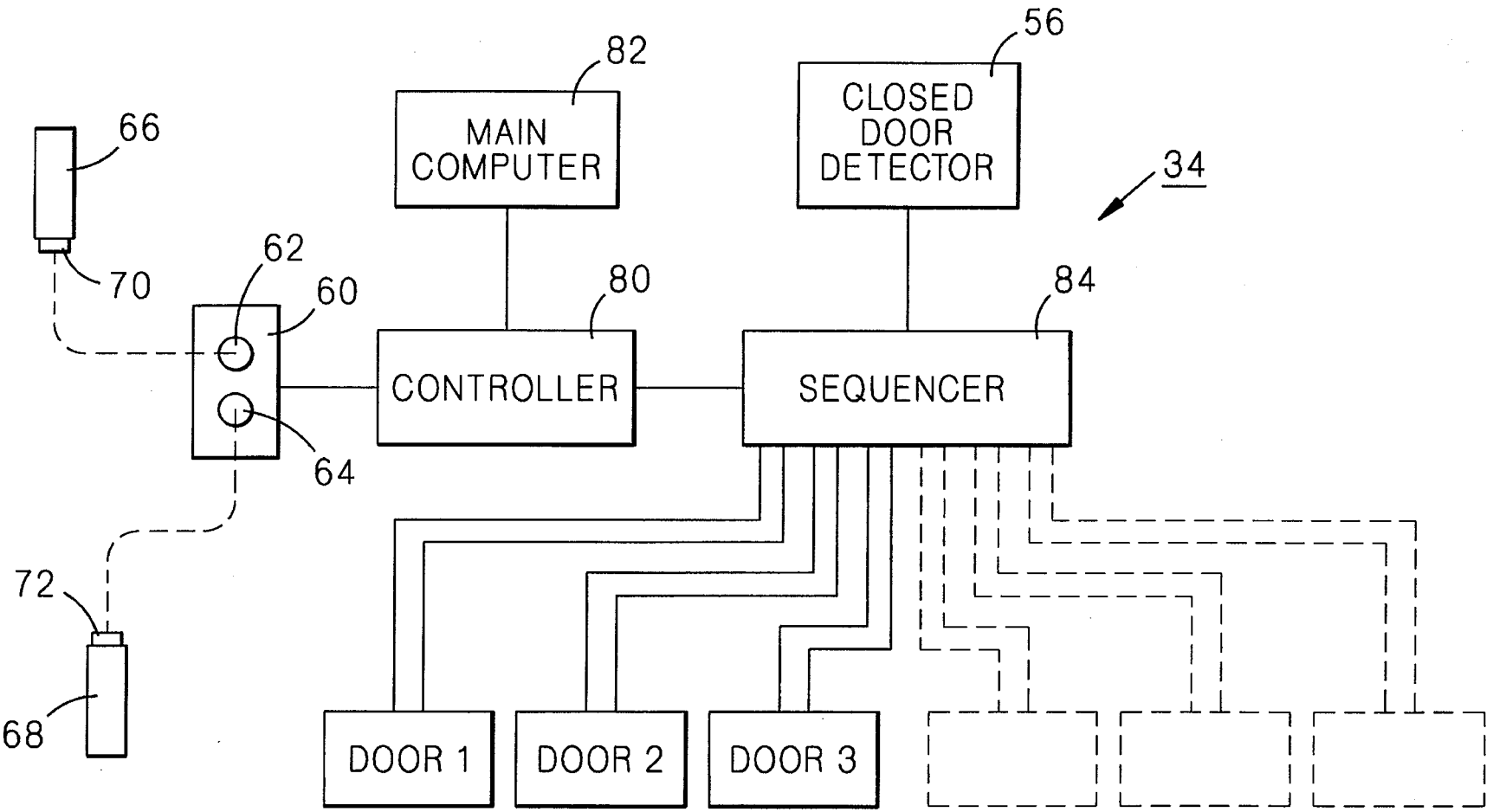
FIG. 4 is a block diagram illustrating the control circuitry of the present invention.

FIG. 4 illustrates the circuitry of control system 34. Circuitry 34 includes a touch pad 60 having included therein two touch receivers 62 and 64. Two touch keys 66 and 68 are provided, the touch keys having disposed thereon, respectively, touch sensors 70 and 72, one key being held by a casino employee and the other key being held by a government inspector. Touch sensors 70 and 72 may be as furnished by Dallas Semiconductor, of Dallas, Tex. Touch keys 66 and 68 may have encoded therein information as to the holder hereof, limitations on access, and locations accessed, for example, which information may be encoded/retrieved by a main computer.

To initiate unlocking, touch sensors 70 and 72 are momentarily touched to touch receivers 62 and 64 and an input signal is sent to a controller 80. Controller 80 may then transmit identification, time, and other information to a main computer 82 for supervisory purposes. Controller 80 activates a sequencer 84 which unlocks a first compartment by energizing solenoid 54 to withdraw pin 52 from engagement with bracket 50 (FIG. 3). Door 32 can then be freely opened and the cash bin therein (not shown) replaced with an empty bin. Door 32 is then manually swung to its closed position which is sensed by closed door detector 56. Closed door detector 56 transmits a signal to sequencer 84 that door 32 is closed and the sequencer immediately causes the next door in sequence to be unlocked and the procedure is repeated until all the compartments in supporting structure 30 have been sequentially accessed. The complete procedure is rapidly and easily completed, since no time is required to unlock individual doors.

The components of system 34 can be easily retrofitted to existing structures.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An apparatus for sequentially unlocking a series of locked compartments, comprising:

(a) means to unlock a first one of said locked compartments so that said first one of said locked compartments can be opened and then closed; and (b) means to sense closing of said first one of said locked compartments and to automatically unlock a second one of said locked compartments in response to said closing of said first one of said locked compartments.

2. An apparatus, as defined in claim 1, wherein: said means to unlock operates in response to the receipt of two separate unlocking signals.

3. An apparatus, as defined in claim 2, wherein: said two separate unlocking signals are inputted to said means to unlock by two touch sensors.

4. A method for sequentially accessing the contents of a series of locked compartments, comprising:

(a) providing means to unlock a first one of said locked compartments so that said first one of said locked compartments can be opened and closed;

providing means to sense closing of said first one of said locked compartments and to automatically unlock a second one of said locked compartments in response to said closing of said first one of said locked compartments;

(c) causing said means to unlock to unlock said first one of said locked compartments;

(d) accessing the contents of said first one of said locked compartments;

(e) closing said first one of said locked compartments; and (f) accessing the contents of said second one of said locked compartments after said means to sense unlocks said second one of said locked compartments.

5. A method, as defined in claim 4, wherein: the step of causing said means to unlock to unlock comprises providing thereto two separate unlocking signals.

6. A method, as defined in claim 5, wherein: the step of providing said two separate unlocking signals comprises providing said two separate unlocking signals with two touch sensors.

* * * * *